US011285582B2

(12) United States Patent
Li

(10) Patent No.: US 11,285,582 B2
(45) Date of Patent: Mar. 29, 2022

(54) SOCKET AND A WRENCH THAT USES THE SAME

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 195 days.

(21) Appl. No.: 16/675,225

(22) Filed: Nov. 6, 2019

(65) Prior Publication Data

US 2021/0129296 A1 May 6, 2021

(51) Int. Cl.
*B25B 13/06* (2006.01)
*B25B 13/46* (2006.01)

(52) U.S. Cl.
CPC ..... *B25B 13/06* (2013.01); *B25B 13/46* (2013.01)

(58) Field of Classification Search
CPC ..... B25B 13/00; B25B 13/06; B25B 13/46; B25B 13/48; B25B 23/00
USPC ..... 81/119, 121, 86, 124
See application file for complete search history.

(56) References Cited

U.S. PATENT DOCUMENTS 4,328,720 A * 5/1982 Shiel ..... B25B 13/06 81/124.6
5,626,062 A * 5/1997 Colvin ..... B25B 13/06 81/177.85
8,056,448 B2 * 11/2011 Chen ..... B25B 13/461 81/121.1
9,718,170 B2 * 8/2017 Eggert ..... B25B 13/065
10,286,526 B2 * 5/2019 Su ..... B25B 23/0071

* cited by examiner

*Primary Examiner* — Orlando E Aviles
*Assistant Examiner* — Jason Khalil Hawkins
(74) *Attorney, Agent, or Firm* — Bruce Stone LLP; Joseph A. Bruce

(57) ABSTRACT

A socket includes two opposite ends and an axis extending between the ends. The socket further includes a small-diameter section in the vicinity of the first end, a large-diameter section in the vicinity of the second end, and a polygonal section between the small-diameter section and the large-diameter section. A circular bore extends in the small-diameter section along the axis. A non-circular bore extends in the polygonal section and the large-diameter section along the axis. Thus, an entire length of the socket and a length of the large-diameter section measured along the axis are rendered relatively small without reducing a depth of the non-circular bore.

9 Claims, 8 Drawing Sheets

SOCKET AND A WRENCH THAT USES THE SAME

BACKGROUND OF INVENTION

1. Field of Invention

The present invention relates to hand tools and, more particularly, to a socket and a wrench that uses the same.

2. Related Prior Art

Taiwanese Patent No. M286747 discloses a socket comprising three sections between two ends. The first section is a short cylindrical section. The second section is a hexagonal section. The third section is a long cylindrical section. In use, the short cylindrical section is engaged with a ratchet wrench, thereby inserting the hexagonal section in the ratchet wrench. The hexagonal section includes an annular flange with a diameter identical to or marginally larger than a diagonal line of the hexagonal section. The annular flange is used to abut against the ratchet wrench, thereby keeping the long cylindrical section completely out of the ratchet wrench.

However, the length of the long cylindrical section plus the thickness of the wrench might be too big for the combination of the socket with the ratchet wrench to be used in a limited space. That is, the long cylindrical section limited the use of the combination to a large space.

The undue length of the socket is attributed to the interior of the socket. Axially, the socket includes a circular bore in communication with a hexagonal bore. The circular bore is made in the short circular section and the hexagonal section. The hexagonal bore is made in the long cylindrical section. The long cylindrical section cannot be made shorter because the depth of the hexagonal bore is regulated by an international protocol.

The present invention is therefore intended to obviate or at least alleviate the problems encountered in prior art.

SUMMARY OF INVENTION

It is an objective of the present invention to provide a socket with a reduced length without reducing a depth of a hexagonal bore in the socket.

To achieve the foregoing objective, the socket includes two opposite ends and an axis extending between the ends. The socket further includes a small-diameter section in the vicinity of the first end, a large-diameter section in the vicinity of the second end, and a polygonal section between the small-diameter section and the large-diameter section. A circular bore extends in the small-diameter section along the axis. A non-circular bore extends in the polygonal section and the large-diameter section along the axis. Thus, an entire length of the socket and a length of the large-diameter section measured along the axis are rendered relatively small without reducing a depth of the non-circular bore.

It is another objective of the present invention to provide a wrench with a socket that includes a reduced length without reducing a depth of a hexagonal bore in the socket.

To achieve the foregoing objective, the wrench includes a head and an annular gear. The head includes circular chamber. The annular gear is rotationally inserted in the circular chamber of the head and formed with a driving internal face including alternatively arranged concave portions and convex portions. The socket includes two opposite ends and an axis extending between the ends. The socket further includes a small-diameter section in the vicinity of the first end, a large-diameter section in the vicinity of the second end, and a polygonal section between the small-diameter section and the large-diameter section. A circular bore extends in the small-diameter section along the axis. A non-circular bore extends in the polygonal section and the large-diameter section along the axis. Thus, an entire length of the socket and a length of the large-diameter section measured along the axis are rendered relatively small without reducing a depth of the non-circular bore. The concave portions are internal times as many as the apexes. At least some of the convex portions are in contact with the facets so that the driving internal face is engaged with the polygonal section to render the socket synchronously rotatable with the annular gear.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
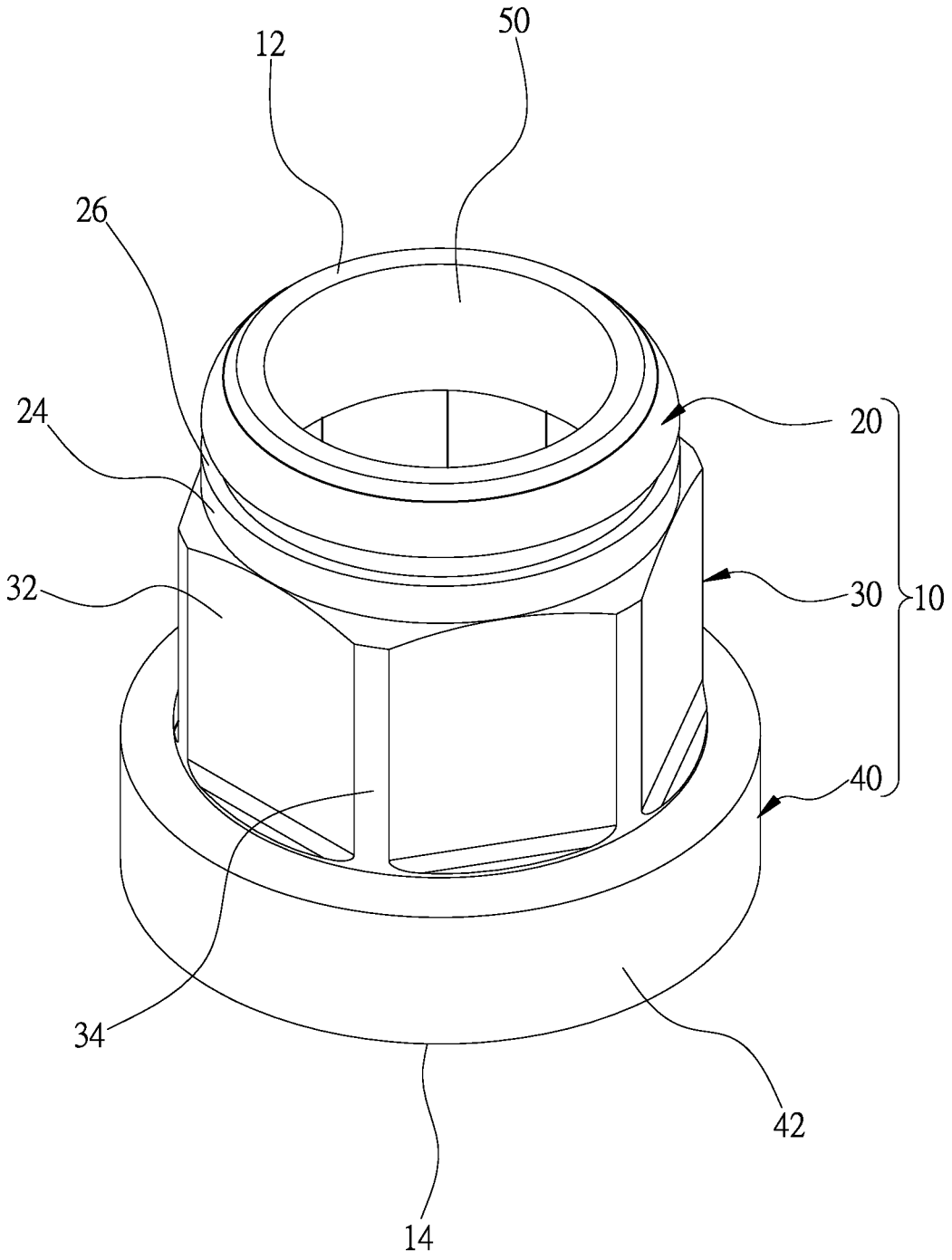
FIG. 1 is a perspective view of a socket according to the first embodiment of the present invention.

Referring to FIG. 1, a socket 10 includes a small-diameter section 20, a polygonal section 30 and a large-diameter section 40 according to a first embodiment of the present invention.

The small-diameter section 20 includes a free end referred to as the "first end 12" of the socket 10. The large-diameter section 40 includes a free end referred to as the "second end 14" of the socket 10. The polygonal section 30 connects the small-diameter section 20 to the large-diameter section 40. Hence, the polygonal section 30 is located between the first and second ends 12 and 14 of the socket 10.

Figure 2:
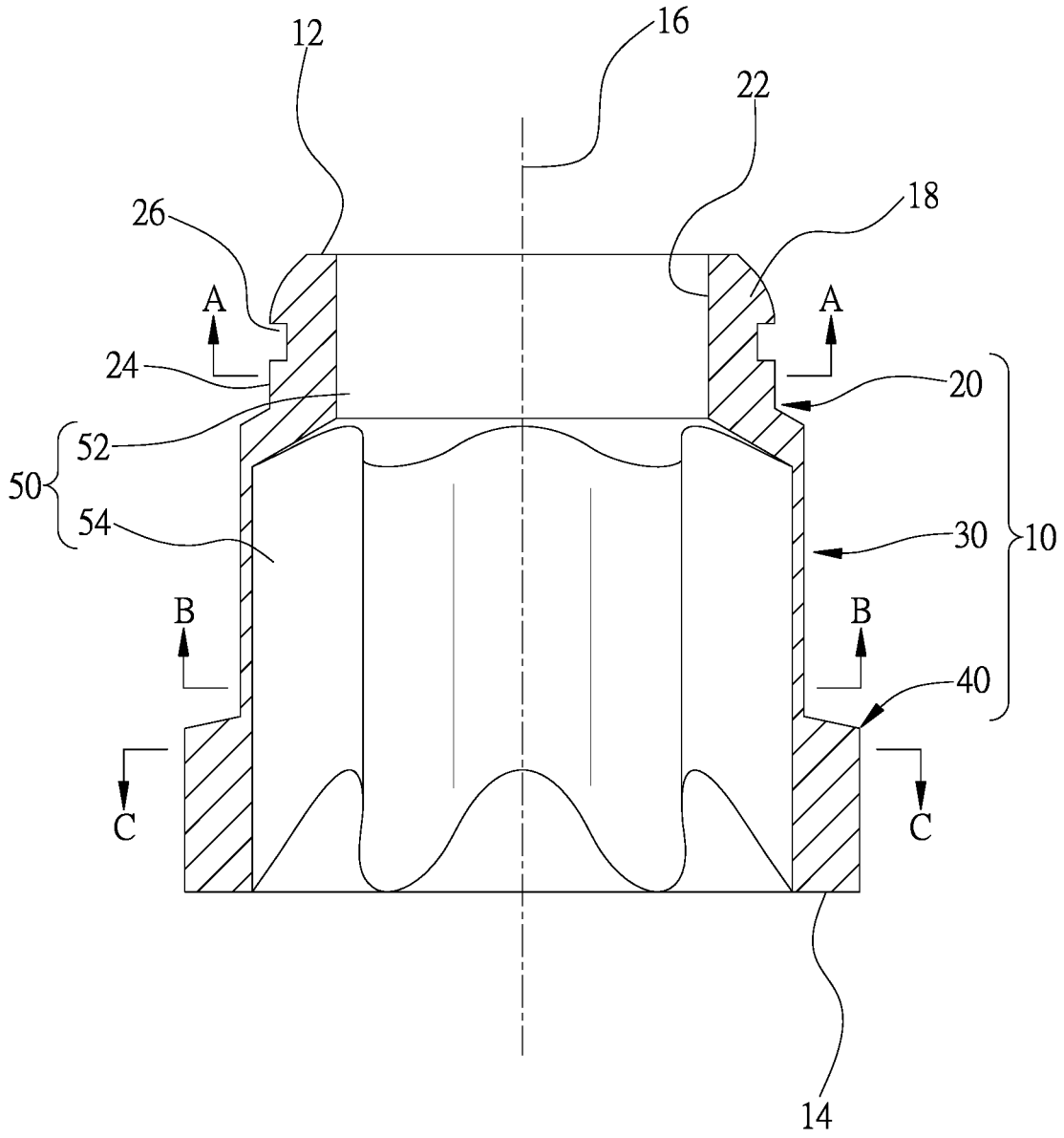
FIG. 2 is a cross-sectional view of the socket shown in FIG. 1.

Referring to FIG. 2, the socket 10 includes a wall 18 extending around an aperture 50. The aperture 50 includes a circular bore 52 in communication with a non-circular bore 54 along an axis 16. The circular bore 52 extends to a root of the small-diameter section 20 from the first end 12 of the socket 10, thereby rendering the small-diameter section 20 annular. The non-circular bore 54 extends to the large-diameter section 40 and the polygonal section 30 from the socket 10 of the second end 14. The depth of the non-circular bore 54 is in compliance with an internal protocol. However, the length of the large-diameter section 40 is relatively short, and so is the entire length of the socket 10. The thickness 28 (FIG. 3) of a section (the "first section") of the wall 18 corresponding to the small-diameter section 20, which extends around the circular bore 52, is larger than the thickness of another section (the "second section") of the wall 18 corresponding to the polygonal section 30, which extends around the non-circular bore 54.

Figure 3:
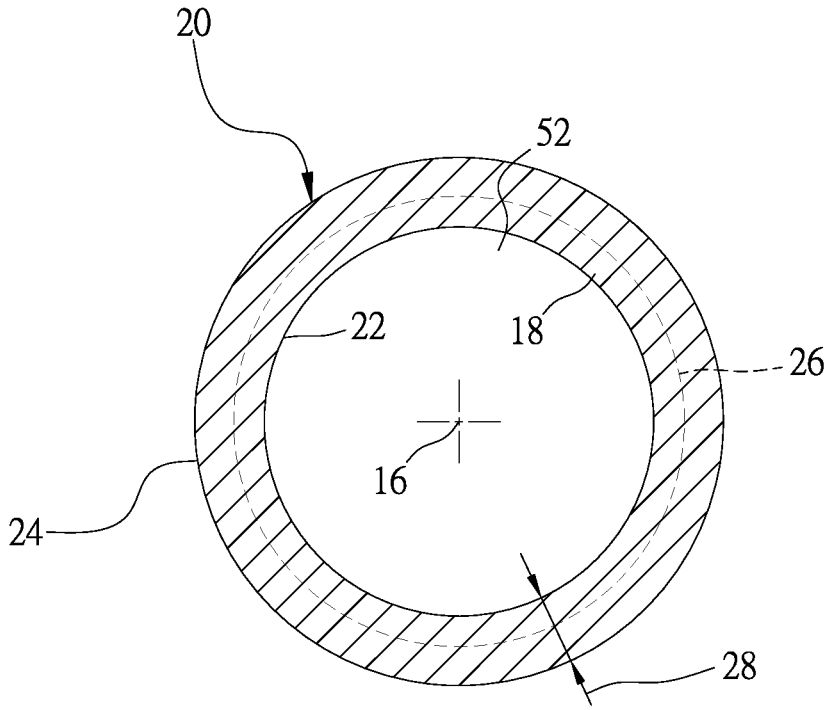
FIG. 3 is a cross-sectional view of the socket taken along a line A-A shown in FIG. 2.

Referring to FIG. 3, the small-diameter section 20 includes an internal face 22 concentric with the external face 24. Each of the internal and external faces 22 and 24 extend in a circle. The thickness 28 is measured from the internal face 22 to the external face 24.

Figure 4:
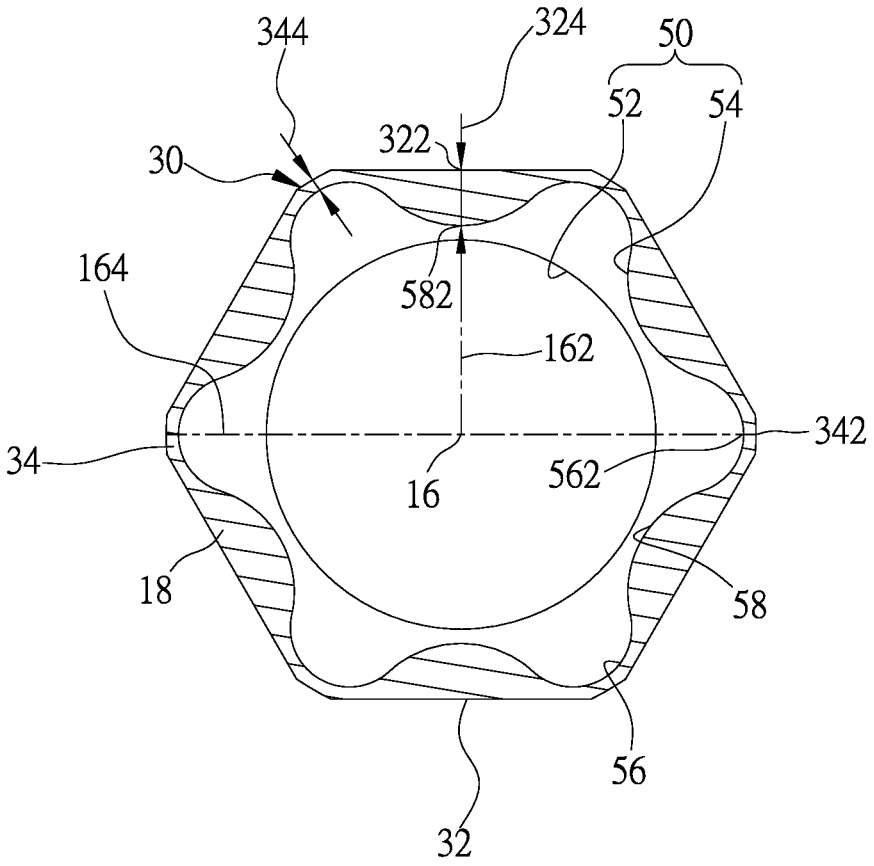
FIG. 4 is a cross-sectional view of the socket taken along a line B-B shown in FIG. 2.

Referring to FIG. 4, the second section of the wall 18 includes a changing thickness. On the outside, the polygonal section 30 includes six (6) facets 32 and six (6) apexes 34. The apexes 34 are preferably chamfered. On the inside, the polygonal section 30 includes six (6) concave facets 56 and six (6) convex facets 58 extending around the non-circular bore 54. Each of the concave facets 56 includes a center 562 corresponding to a center 342 of a corresponding one of the apexes 34. Each of the convex facets 58 includes a center 582 corresponding to a center 322 of a corresponding one of the facets 32. The second section of the wall 18, which extends around the non-circular bore 54, includes a changing thickness.

A first radius 162 can be drawn from the axis 16 to the center 322 of each of the facets 32. The first radius 162 goes through the center 582 of the corresponding convex facet 58. A linear distance of a center 582 from the corresponding center 322 is referred to as the "maximum thickness 324" of the second section of the wall 18. The thickness of the second section of the wall 18 gets smaller in a direction away from the first radius 162 in a symmetric manner.

A second radius 162 extends to the center 342 of each of the apexes 34 from the axis 16 through the center 562 of a corresponding one of the concave facets 56. A linear distance of the center 562 from the center 342 is referred to as the "minimum thickness 344" of the second section of the wall 18. The thickness of the second section of the wall 18 gets larger in a direction away from the second radius 162 in a symmetric manner. The maximum thickness 324 is larger than the minimum thickness 344.

The ratio of the number of the apexes 34 over the number of the concave facets 56 is preferably 1:1. The ratio of the number of the facets 32 over the number of the convex facets 58 is preferably 1:1. A diameter 164 is drawn from the axis 16. The diameter 164 extends through two centers 342 and two centers 562. Another diameter can be drawn from the axis 16 to extend through two centers 322 and two centers 582.

Figure 5:
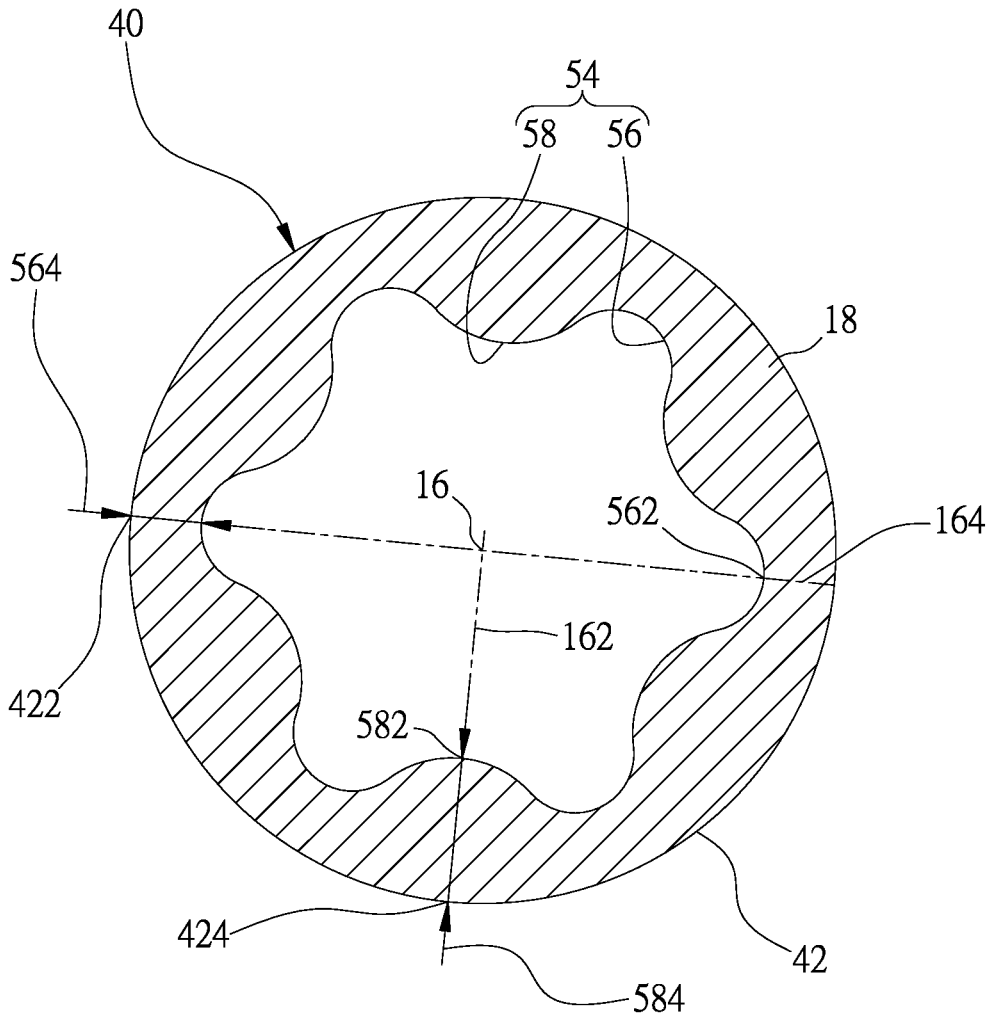
FIG. 5 is a cross-sectional view of the socket taken along a line C-C shown in FIG. 2.

Shown in FIG. 5 is a section (the "third section") of the wall 18 corresponding to the large-diameter section 40. The third section of the wall 18 includes a changing thickness because a distance of a periphery 42 from an internal face of this portion of the wall 18 measured along a radius is different from measured along another radius.

A radius 162 extends through a point 422 in the periphery 42 and the center 562 of one of the concave facets 56. A linear distance of the center 582 of each convex facet 58 from the corresponding point 424 is the maximum thickness 584 of the third section of the wall 18.

A diameter 164 goes through two points 422 of the periphery 42 and the centers 562 of two opposite concave facets 56. A linear distance of each center 562 to the corresponding point 422 is the minimum thickness 564 of the third section of the wall 18.

Figure 6:
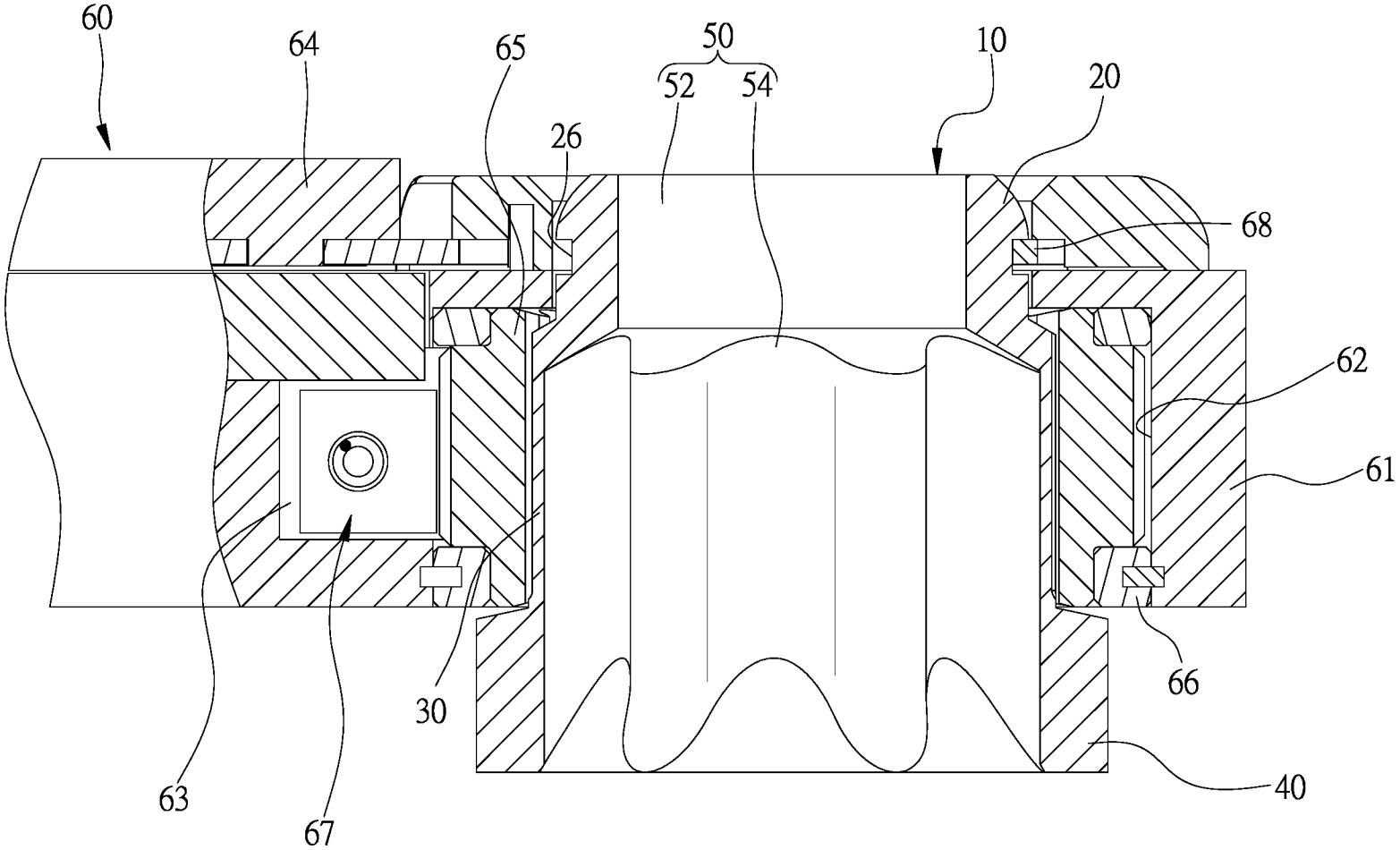
FIG. 6 is a partial and cross-sectional view of a ratchet socket and the socket shown in FIG. 1.
Figure 7:
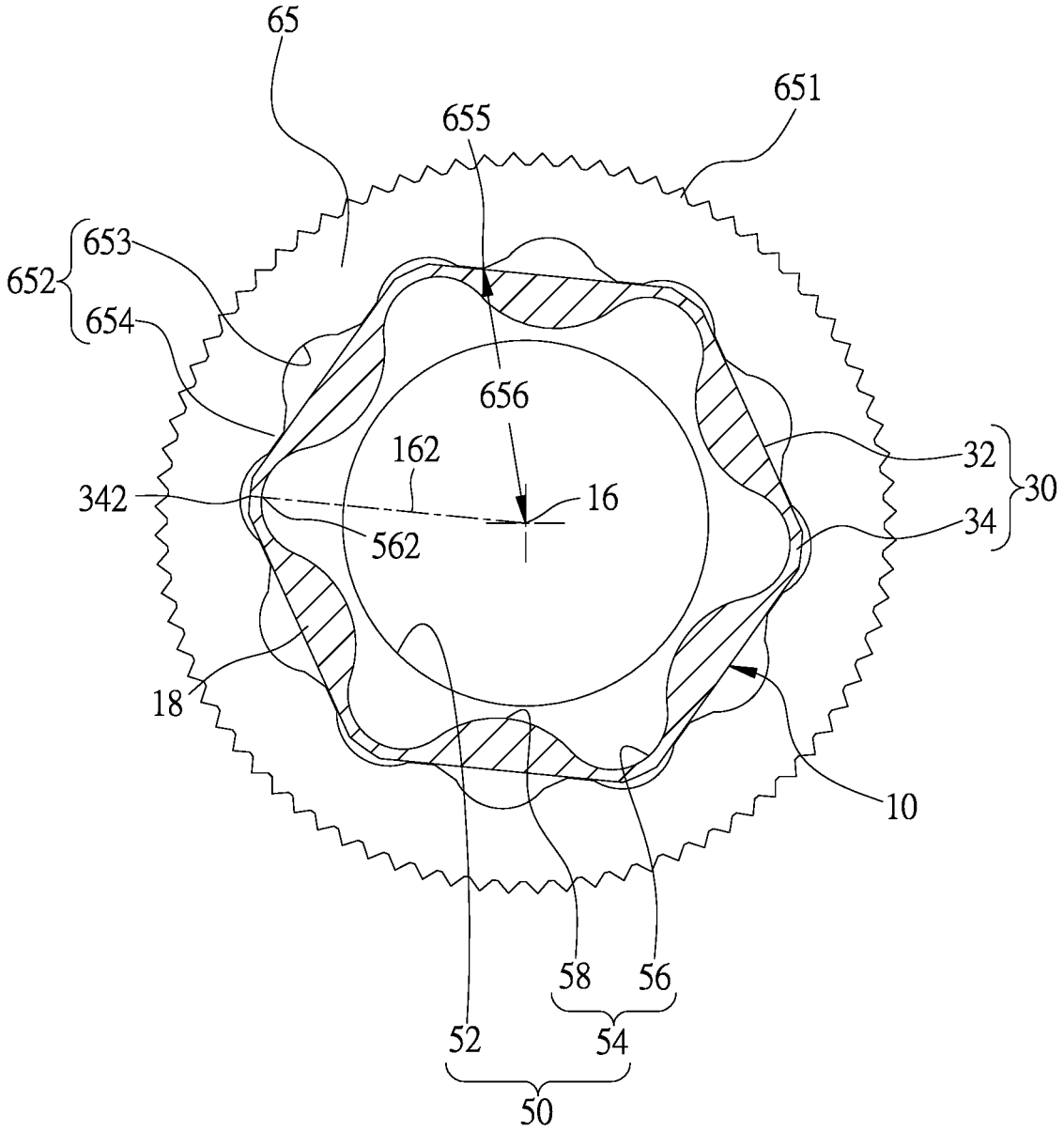
FIG. 7 is a top view of an annular gear of the ratchet socket and the socket shown in FIG. 6.

Referring to FIGS. 6 and 7, the socket 10 is engaged with a wrench 60. The wrench 60 includes a head 61 formed at an end of a handle (not numbered). The head 61 is hollow element made of metal. The head 61 includes a circular chamber 62 in communication with a crescent chamber 63. A ring 66 is inserted in the circular chamber 62 of the head 61. A C-clip (not numbered) includes an internal edge (not numbered) inserted in a groove (not numbered) made in an external face of the ring 66 and an external edge (not numbered) inserted in a groove (not numbered) made in an internal face of the head 61, thereby connecting the ring 66 to the head 61. An annular gear 65 is rotationally inserted in the circular chamber 62. The annular gear 65 is supported on the ring 66. A ratchet assembly 67 is inserted in the crescent chamber 63. The ratchet assembly 67 includes at least one pawl (not numbered) for engagement with the teeth 651 formed on an internal face of the annular gear 65 to determine a sense of direction in which the head 61 rotates the annular gear 65 via the ratchet assembly 67. Supported on the head 61 is a switch 64 that is operable to switch the sense of direction in which the head 61 rotates the annular gear 65 via the ratchet assembly 67.

The annular gear 65 includes a driving internal face 652. The driving internal face 652 includes a number of concave portions 653 and an identical number of convex portions 654. For example, there are twelve (12) concave portions 653, twice as many as the apexes 34. Accordingly, there are twelve (12) convex portions 654, twice as many as the facets 32.

In another embodiment, the concave portions 653 can be one (1), three (3), four (4) or any proper integral times as many as the apexes 34.

In the case where the concave portions 653 are as many as the apexes 34, the six concave portions 653 receive the six apexes 34. The six convex portions 654 contact the six facets 32.

In the case where the concave portions 653 are three times as many as the apexes 34. Six of the eighteen concave portions 653 receive the six apexes 34. Some of the eighteen convex portions 654 contact the six facets 32.

In the case where the concave portions 653 are four times as many as the apexes 34. Six of the twenty-four concave portions 653 receive the six apexes 34. Some of the twenty-four convex portions 654 contact the six facets 32.

The small-diameter section 20 extends out of the head 61 via a space surrounded by the driving internal face 652. The large-diameter section 40 is stopped by the annular gear 65. There is a groove 26 in an external face of the small-diameter section 20. The groove 26 receives an internal edge of a C-clip 68. A portion of a lower face of the C-clip 68 near an external edge is abutted against an upper face of the head 61. Moreover, an upper face of the large-diameter section 40 is abutted against a lower face of the annular gear 65, which is kept in the head 61. Thus, the polygonal section 30 of the socket 10 and the annular gear 65 are kept in the head 61. Accordingly, the polygonal section 30 is kept in engagement with the driving internal face 652, thereby rendering the socket 10 synchronously rotatable with the annular gear 65.

The concave portions 653 receive the apexes 34. The convex portions 654 contact the facets 32. There is a contact point 655 of each convex portion 654 with the corresponding facet 32. The contact point 655 is at a distance 656 from the axis 16. Each of the facets 32, the apexes 34, the concave portions 653 and the convex portions 654 is symmetric with regard to a corresponding radius. Hence, the distances 656 are identical to each other. When the head 61 is operable to rotate the annular gear 65, the convex portions 654 exert forces on the facets 32. The forces cross the distance 656 to produce a torque that rotates the polygonal section 30 with the annular gear 65. The distances 656 are identical to each other so that the convex portions 654 of the annular gear 65 exert identical forces on the polygonal section 30. Accordingly, the head 61 smoothly rotates the socket 10.

Similarly, the non-circular bore 54 can receive a workpiece such as a nut, a head of a threaded bolt, an extensive rod and a tool bit (not shown). The workpiece includes several portions in contact with the convex facets 58. There is a contact point of each of the portions of the workpiece with the corresponding convex facet 58. The contact points are at identical distances from an axis of the workpiece. Thus, the socket 10 smoothly rotates the workpiece.

Figure 8:
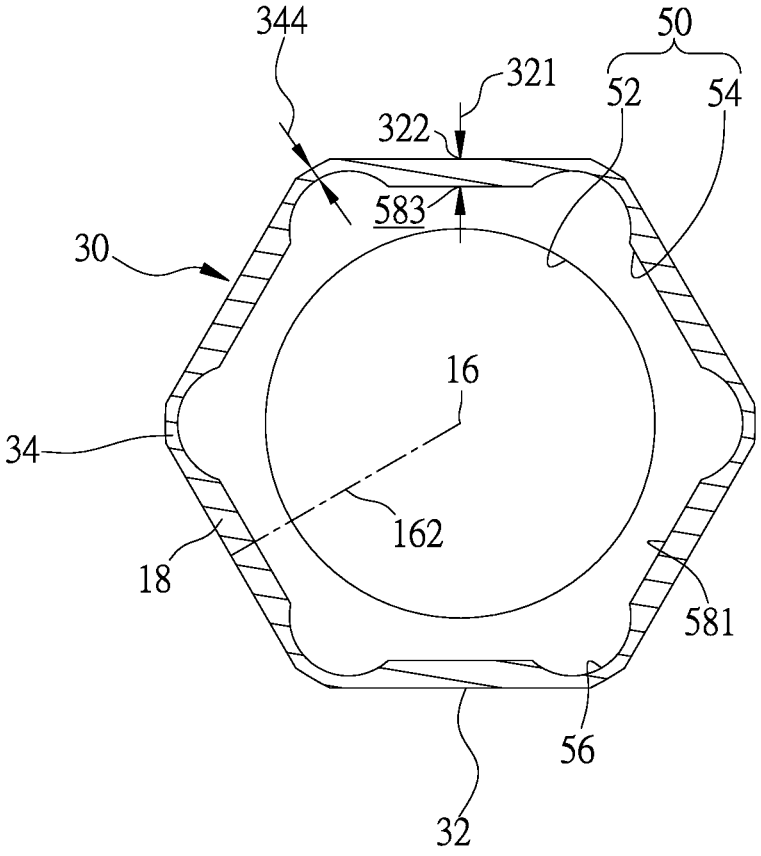
FIG. 8 is a cross-sectional view of a socket according to the second embodiment of the present invention.

Referring to FIG. 8, there is a socket according to a second embodiment of the present invention. The second embodiment is identical to the first embodiment except that the non-circular bore 54 is in a different shape.

The non-circular bore 54 includes planar facets 581 instead of the convex faces 58. Each of the planar facets 581 extend between two of the concave facets 56.

A radius 162 that extends to from the center 322 of each of the facets 32 from the axis 16 goes through the center 583 of the planar facet 581. A linear distance of each center 322 from the corresponding center 583 is the thickness 321 of the wall 18 corresponding to the facets 32. The thickness 321 is larger than the thickness 344 of the wall 18 corresponding to the apexes 34.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A socket comprising:

a first end, a second end opposite to the first end, a small-diameter section in the vicinity of the first end, a large-diameter section in the vicinity of the second end, and a polygonal section between the small-diameter section and the large-diameter section;

an axis extending to the second end of the socket from the first end of the socket;

a circular bore extending in the small-diameter section along the axis; and a non-circular bore extending in the polygonal section and the large-diameter section along the axis, thereby rendering a sum of a length of the polygonal section and a length of the large-diameter section measured along the axis substantially equal to a depth of the non-circular bore measured along the axis, wherein the non-circular bore is used to receive a non-circular portion of an object to be rotated by the socket, wherein the non-circular bore is in a same shape throughout the depth.

2. The socket according to claim 1, wherein the polygonal section is formed with an external face comprising alternately arranged external facets and apexes, and the socket is formed with an internal face comprising alternately arranged concave internal facets and convex internal facets surrounding the non-circular bore, and a ratio of the number of the apexes over the number of the concave internal facets is 1:1, and each of the apexes comprises a center, and each of the concave internal facets comprises a center at a same radius with the center of a corresponding one of the apexes, and each of the external facets comprises a center, and each of the convex internal facets comprises a center at a same radius with the center of a corresponding one of the external facets.

3. The socket according to claim 2, wherein each of the apexes is symmetric with respect to the center thereof.

4. The socket according to claim 2, wherein each of the external facets is symmetric with respect to the center thereof.

5. The socket according to claim 1, wherein the polygonal section is formed with an external face comprising alternately arranged facets and apexes, and the socket is formed with an internal face comprising alternately arranged concave internal facets and planar facet surround the non-circular bore, and a ratio of the number of the apexes over the number of concave internal facets is 1:1, and each of the apexes comprises a center, and each of the concave internal facets comprises a center at a same radius with the center of a corresponding one of the apexes, and each of the external facets comprises a center, and each of the planar facets comprises a center at a same radius with the center of a corresponding one of the external facets.

6. The socket according to claim 5, wherein each of the apexes is symmetric with respect to the center thereof.

7. The socket according to claim 5, wherein each of the external facets is symmetric with respect to the center thereof.

8. A wrench comprising:

a head comprising a circular chamber;

an annular gear rotationally inserted in the circular chamber of the head and formed with a driving internal face comprising alternatively arranged concave portions and convex portions; and a socket comprising:

a first end, a second end opposite to the first end, a small-diameter section in the vicinity of the first end, a large-diameter section in the vicinity of the second end, and a polygonal section between the small-diameter section and the large-diameter section;

an axis extending to the second end of the socket from the first end of the socket;

a circular bore extending in the small-diameter section along the axis; and a non-circular bore extending in the polygonal section and the large-diameter section along the axis, thereby rendering a sum of a length of the polygonal section and a length of the large-diameter section measured along the axis substantially equal to a depth of the non-circular bore measured along the axis, wherein the non-circular bore is used to receive a non-circular portion of an object to be rotated by the socket, wherein the non-circular bore is in a same shape throughout the depth;

wherein a number of the concave portions is as many as a number of the apexes, and at least some of the convex portions are in contact with the external facets so that the driving internal face is engaged with the polygonal section to render the socket synchronously rotatable with the annular gear.

9. The socket according to claim 8, wherein at least some of the concave portions receive the apexes, and each of the apexes is in contact with a corresponding one of the convex portions of the driving internal face at a contact point, and the contact points are at a same distance from the axis of the socket.

* * * * *